US010265555B2

(12) United States Patent
Wu

(10) Patent No.: US 10,265,555 B2
(45) Date of Patent: Apr. 23, 2019

(54) ANTI-FALLING DEVICE WITH ROPE RETRACTABLE SYSTEM

(71) Applicant: Fang-Kuan Wu, Taichung (TW)

(72) Inventor: Fang-Kuan Wu, Taichung (TW)

( * ) Notice: Subject to any disclaimer, the term of this patent is extended or adjusted under 35 U.S.C. 154(b) by 312 days.

(21) Appl. No.: 15/185,033

(22) Filed: Jun. 17, 2016

(65) Prior Publication Data

US 2017/0361136 A1 Dec. 21, 2017

(51) Int. Cl.
*A62B 35/00* (2006.01)

(52) U.S. Cl.
CPC ..... *A62B 35/0093* (2013.01)

(58) Field of Classification Search
CPC ..... A62B 35/0093
See application file for complete search history.

(56) References Cited

U.S. PATENT DOCUMENTS 2,791,397 A * 5/1957 Coffman ..... A62B 35/0093 182/239
4,253,643 A * 3/1981 Forester ..... A62B 1/10 182/239
4,493,396 A * 1/1985 Borgia ..... A62B 1/08 182/233
4,846,313 A * 7/1989 Sharp ..... A62B 35/0093 188/187
4,930,719 A * 6/1990 Sehl ..... B63B 35/816 114/254
5,351,906 A * 10/1994 Feathers ..... A62B 1/10 182/237
8,245,817 B2 * 8/2012 Casebolt ..... A62B 35/0093 182/231
8,516,979 B2 * 8/2013 Ek ..... B65H 75/4431 119/796
2008/0041661 A1 * 2/2008 Meillet ..... A62B 35/0093 182/13
2017/0307031 A1 * 10/2017 Gross ..... F16D 49/20

* cited by examiner

*Primary Examiner* — Katherine W Mitchell
*Assistant Examiner* — Candace L Bradford
(74) *Attorney, Agent, or Firm* — Leong C. Lei

(57) ABSTRACT

An ant-falling device includes a shell, a first axle and a second axle supported therein, a buffer unit coupled at the first axle, and a reel spring for retracting the buffer unit. The buffer unit includes a rope reel and a driven gear. The second axle includes a driving gear, a first buckling member, and a handle that controls the driving gear to engage with the driven gear for retracting a rope via the rope reel. The shell includes a button, having a second buckling member, movably mounted thereon and being pushed by a spring. When the driving gear is engaged with the driven gear, the button is actuated to couple the second buckling member with the first buckling member to enable the rope being smoothly retracted. As the button is pressed, the first buckling member is released to disengage the driving gear with the driven gear.

18 Claims, 8 Drawing Sheets

ANTI-FALLING DEVICE WITH ROPE RETRACTABLE SYSTEM

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an anti-falling device, and more particular to an anti-falling device with a rope retractable system, which prevents the failure operation of the anti-falling and stalling of the anti-falling device during the retracting operation of the rope.

Description of Related Arts

It is noted that because conventional anti-falling device cannot forcibly retrieve the rope after a user has fallen with it, it is not only disadvantageous for subsequent rescue works, but wasting for lacking of reusability. In order to solve these issues, the present applicant has submitted the Pat. No. 098220213 (Taiwan) invention of "Anti-falling Device of Forcibly Retrieving" in respondence.

However, a few drawbacks were found in this prior invention during the demonstrations and promotions of its product. The swing handle of this prior invention will inevitably move the shaft left and right during the process of forcible rope retrieving, which causes the driving gear fail to stably engage with the driven gear. It could reduce the expected life of the device, or, even worse, cause gear failure that lets the falling user stall and fall again. Therefore, it really requires further improvement.

Hence, the present inventor, based on the spirit of continuous improvement and constant studying and testing, has invented the present invention that is able to improve on the above mentioned issues of the prior art.

SUMMARY OF THE PRESENT INVENTION

The present invention is a rope retractable anti-falling device comprising:

a shell, defining a chamber therein and having a brake member fixed at a side of the chamber;

a first axle across the chamber;

an autorotatable buffer unit mounted on the first axle, wherein the buffer unit is formed of a rope reel, a braking disk, a brake pad, and a driven gear, wherein the rope reel has a rope embraced thereon, wherein when a user is falling with the rope, the braking disk is allowed to buckle on the brake member to force the rope reel to decelerate the rotation due to bearing the friction of the brake pad;

a reel spring mounted in the chamber, wherein the reel spring rewinds the buffer unit back;

a second axle across said chamber having the driving gear mounted thereon, a handle coupled thereon in the outside of the shell, and a first buckling member, wherein the handle controls the second axle to move along the axial direction thereof between a first position and a second position, wherein when the second axle is at the first position, the driving gear engages with the driven gear, so as to forcibly retrieve the rope by rotating the handle, wherein when the second axle is at the second position, the driving gear disengages from the driven gear;

a button, which has a second buckling member, slippingly mounted on the shell and pushed by a spring, so as to make the second buckling member automatically buckle on the first buckling member without interfering the autorotation of the second axle when the second axle is at the first position, wherein when the button is actuated to press the spring to a designated position, the first buckling member will be released so as to let the second axle move to the second position.

Hence, in the present invention the handle brings the second axle to the first position. In addition, when the second axle is rotated to forcibly retrieve the rope, because the second buckling member limits the first buckling member, the second axle will not wobble axially or laterally easily when the handle is bringing the second axle to autorotate. Therefore, a stable transmission between the driving gear and the driven gear can be maintained, which gets rid of the failure and stalling problems in the process of rope retrieving of the above prior art and provides a novel and effective technique for current rope retractable anti-falling device.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
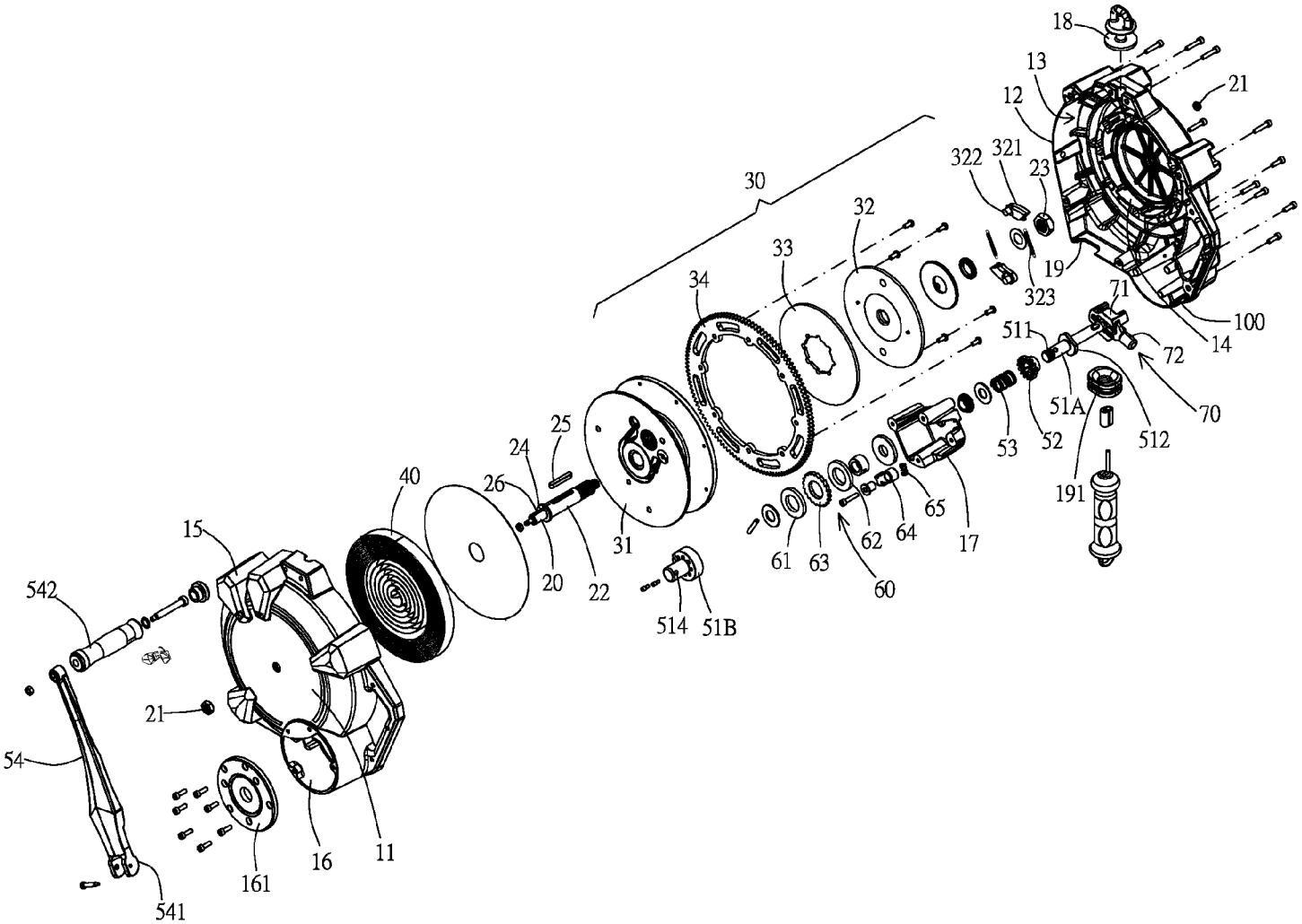
FIG. 1 is an exploded perspective view of an anti-falling device with a rope retractable system according to a preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1 to 10 of the drawing, an anti-falling device according to the preferred embodiment of the present invention is illustrated, wherein the anti-falling device comprises a shell 10, a first axle 20, a buffer unit 30, a reel spring 40, a linkage structure, an unidirectional rotating structure 60, and a protective structure 70.

Figure 3:
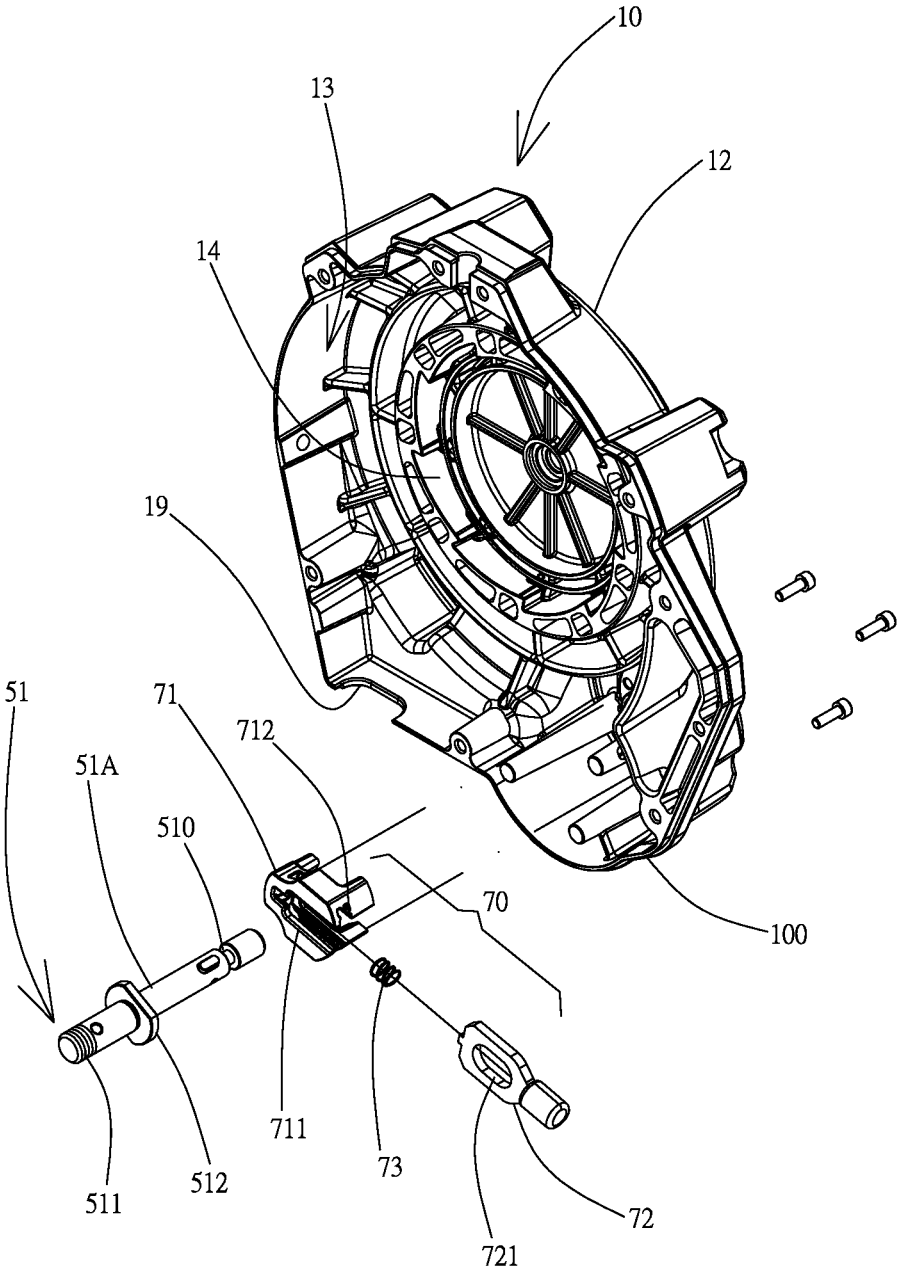
FIG. 3 is an exploded perspective view of the anti-falling device with the rope retractable system according to the preferred embodiment of the present invention, illustrating the second axle of the present invention.
Figure 4:
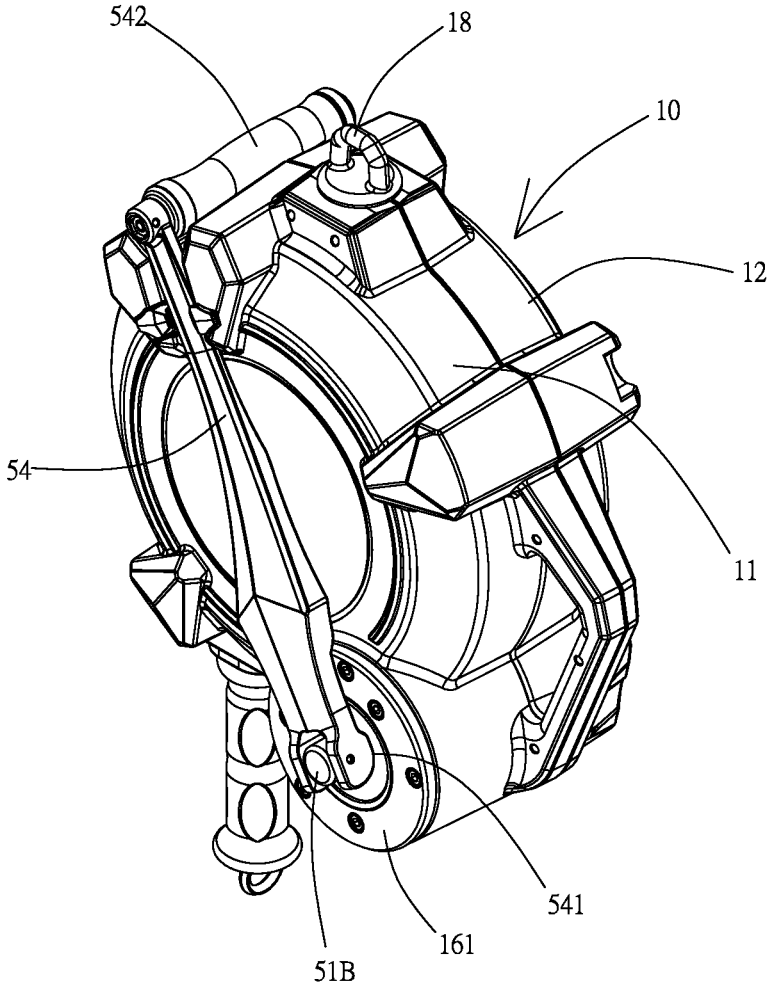
FIG. 4 is a perspective view of the anti-falling device with the rope retractable system according to the preferred embodiment of the present invention, illustrating the rope not being retracted.
Figure 5:
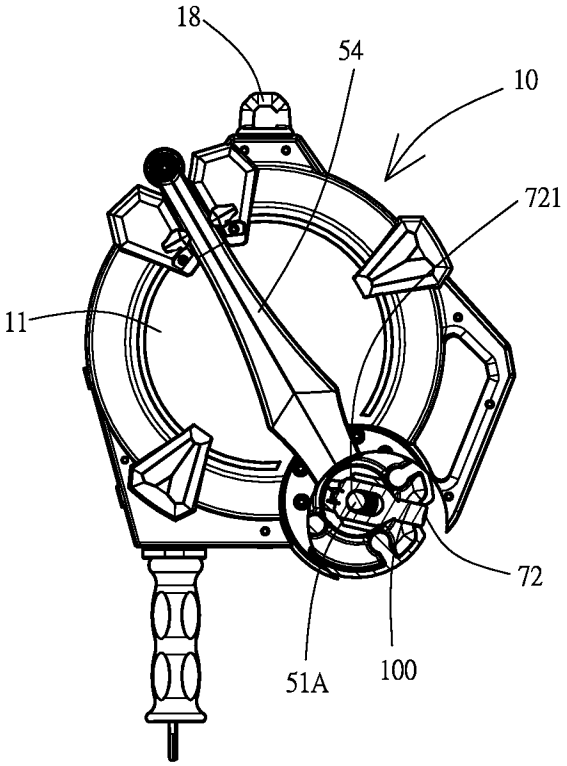
FIG. 5 is a side view of the anti-falling device with the rope retractable system according to the preferred embodiment of the present invention.
Figure 6:
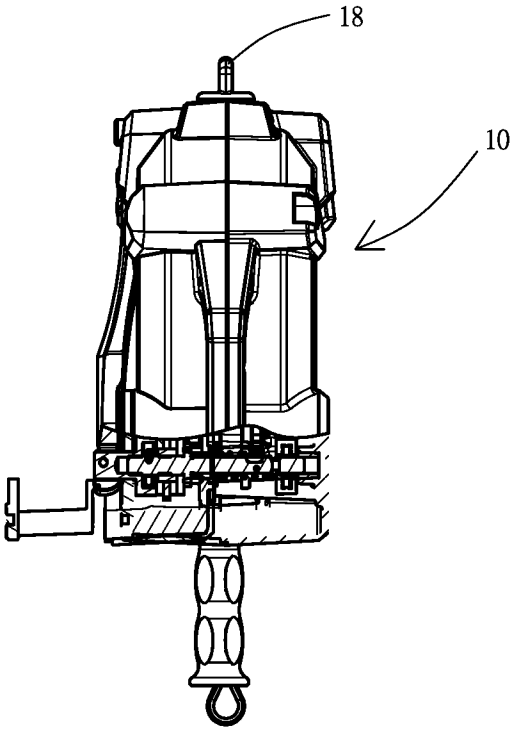
FIG. 6 is a front view of the anti-falling device with the rope retractable system according to the preferred embodiment of the present invention.
Figure 7:
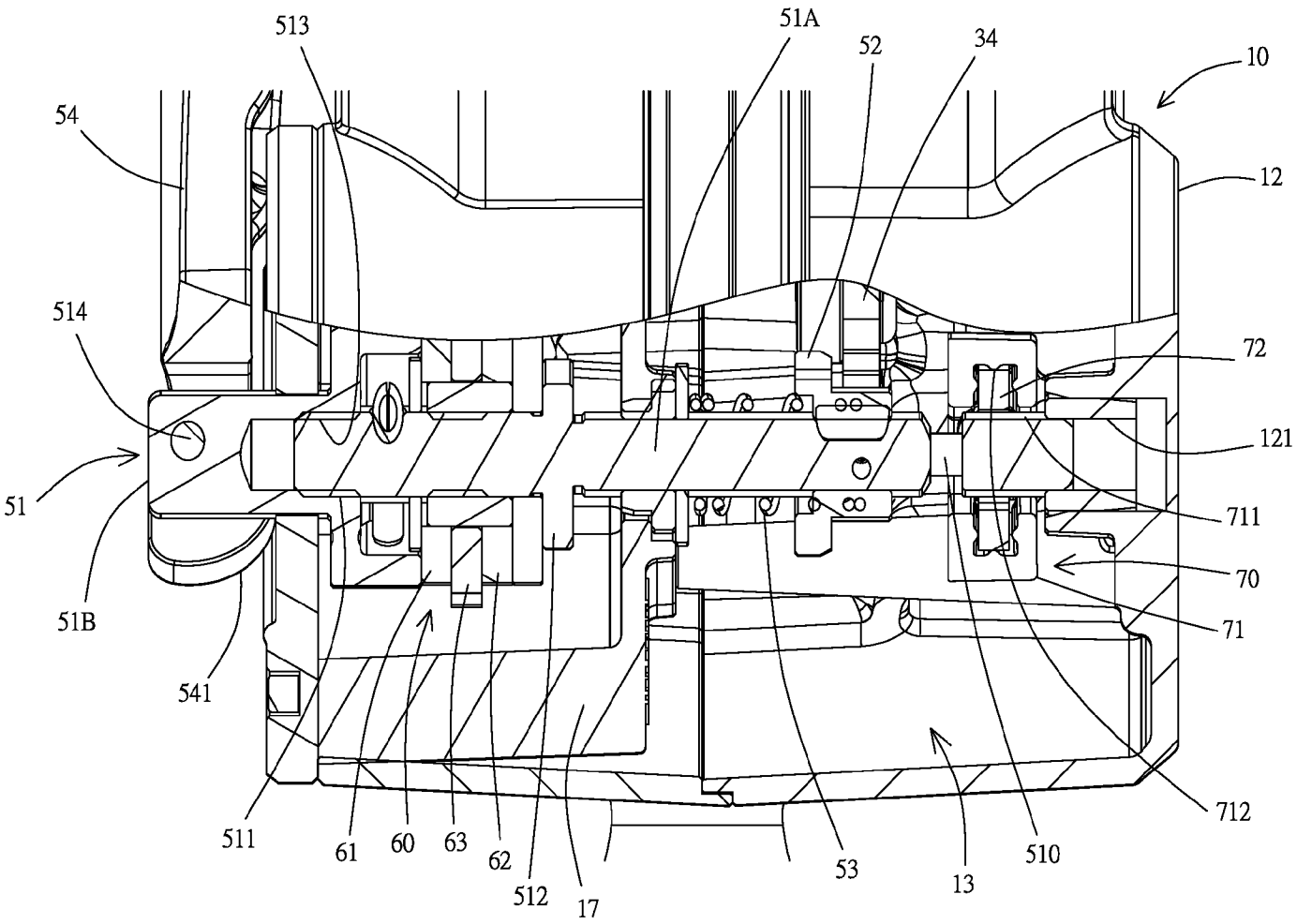
FIG. 7 is a sectional view of the anti-falling device with the rope retractable system according to the preferred embodiment of the present invention, illustrate the unidirectional rotating structure.
Figure 8:
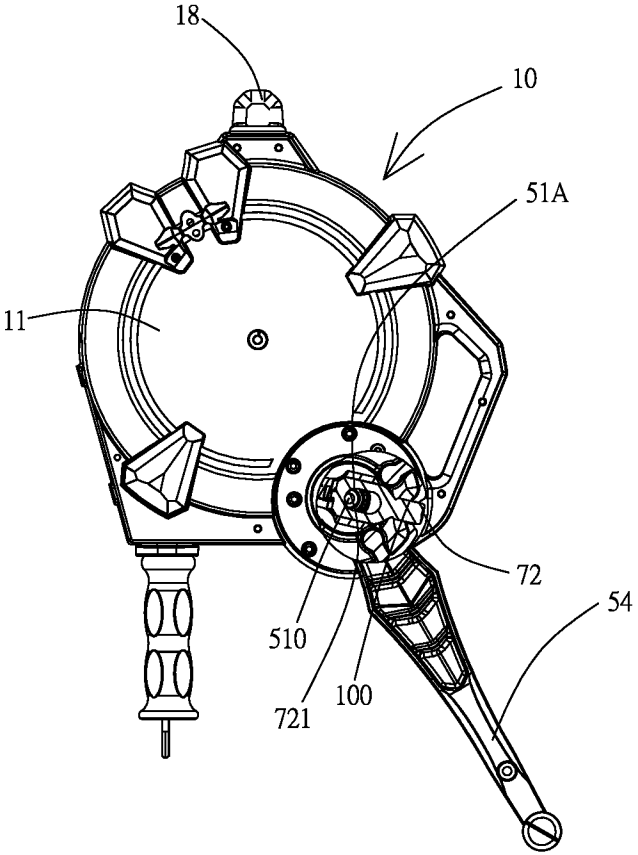
FIG. 8 is a side view illustrating the rope retraction operation of the anti-falling device with the rope retractable system according to the preferred embodiment of the present invention.
Figure 9:
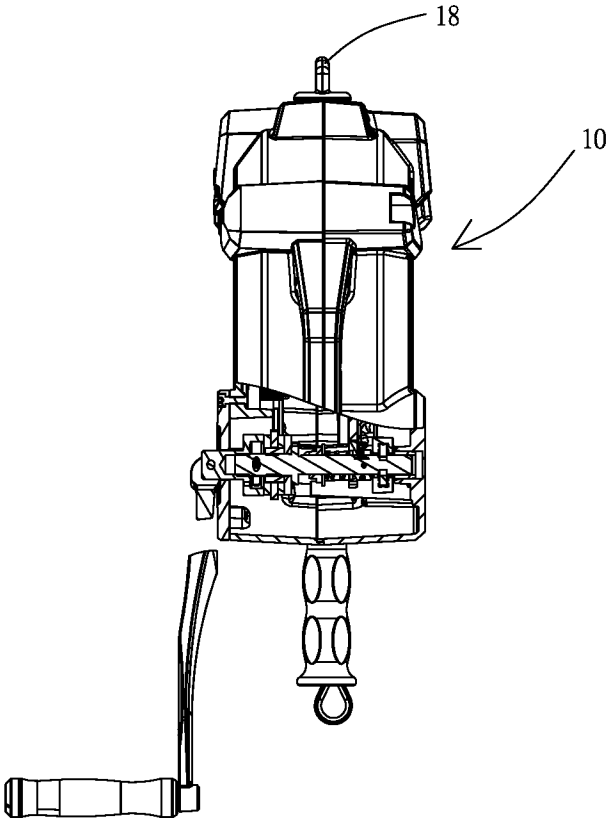
FIG. 9 is a front view illustrating the rope retraction operation of the anti-falling device with the rope retractable system according to the preferred embodiment of the present invention.
Figure 10:
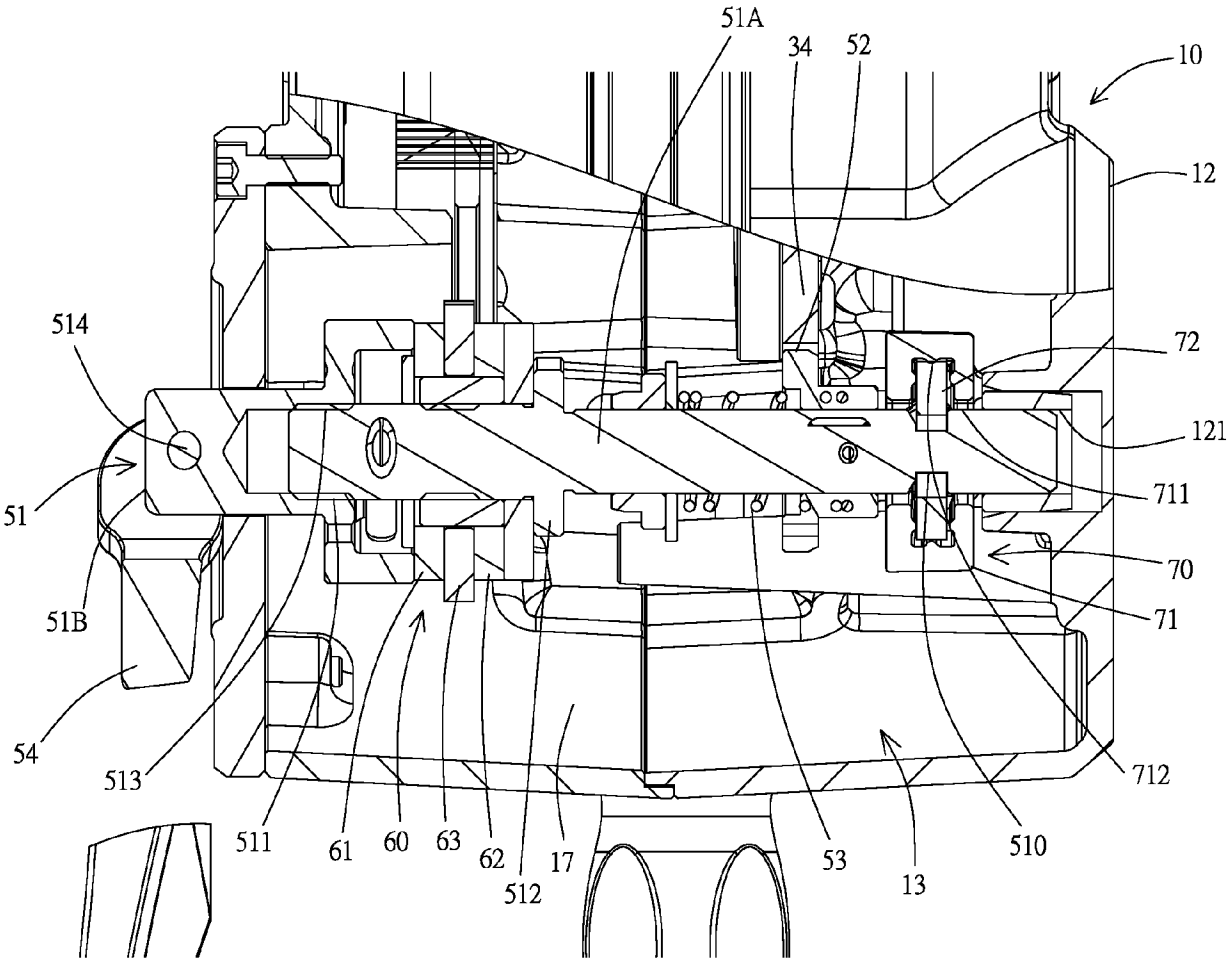
FIG. 10 is partially sectional view of the anti-falling device with the rope retractable system according to the preferred embodiment of the present invention, illustrating the rope retraction operation.

As shown in FIGS. 1, 3, and 4, the shell 10 which is constructed to have a left cover 11 and a right cover 12 interlocked with each other to define a hollow chamber 13 therewithin. The right cover 12 comprises a first axle seat 121 extended from an inner wall of the right cover 12 at a peripheral portion thereof within the hollow chamber 13, as shown in FIG. 7, and a brake member 14 formed at the inner wall of the right cover 12. The brake member 14 has a ratchet surrounding wall.

The left cover 11 has a retaining groove 15 indently formed at the peripheral edge of the left cover 11, and a mounting hole 16 formed at an inner wall of the left cover 11 to align with the first axle seat 121 when the left cover 11 is coupled to the right cover 12. A second axle seat 161 is coupled at an outer side of the left cover 11 to enclose the mounting hole 16. The shell 10 further comprises a third axle seat 17 mounted between the first axle seat 121 and the second axle seat 161 as shown in FIG. 7. The shell 10 further comprises a hook 18 mounted on the top thereof for hanging purpose, and a perforation 19 formed at the bottom thereof to communicate the interior of the shell 10 and an exterior thereof. A sheathing 191 is mounted at a surrounding edge of the perforation 19.

As shown in FIG. 1, the first axle 20 is transversely extended to across the chamber 13, wherein the first axle 20 has two end lockers 21, preferably two threaded lockers, provided at two ends of the first axle 20 to lock up the left cover 11 and the right cover 12 respectively. The first axle 20 is coaxial to the brake member 14, preferably, the first axle 20 is located at a center of the brake member 14.

The first axle 20 comprises a bushing 22 coaxially and rotatably coupled at the periphery of the first axle 20, wherein a length of the bushing 22 is shorter than a length of the first axle 20, such that the first axle 20 is coaxially passed through the bushing 22 at a position that the two ends of the first axle 20 are located out of the bushing 22. A lock nut 23 is coupled with one end of the bushing 22 having a threaded structure, while a yoke 24 is coaxially extended from another end of the bushing 22, wherein a diameter of the yoke 24 is smaller than a diameter of the bushing 22. A keyed block 25 is provided between the lock nut 23 and the yoke 24. An inserting slot 26 is indently formed along an outer surface of the yoke 24.

As shown in FIG. 1, the buffer unit 30 is coaxially coupled at the first axle 20, wherein the buffer unit 30 comprises a rope reel 31 for winding a rope, a braking disk 32 positioned adjacent to the brake member 14, a brake lining 33 sandwiched between the rope reel 31 and the braking disk 32, and a driven gear 34 circularly mounted at a right side of the rope reel 31. Accordingly, the rope has one end securely affixed at the rope reel 31 and an opposed end being pulled out of the shell 10 through the perforation 19 in order to tighten or fasten to a user via a hook joint as an example. The rope reel 31, the braking disk 32, the brake lining 33, and the driven gear 34 are coaxial with each other to have a common center hole that the bushing 22 is inserted therethrough. Therefore, the rope reel 31, the braking disk 32, the brake lining 33 can be clamped and held between the lock nut 23 and the yoke 24. In addition, the keyed block 25 is coupled to the rope reel 31 only, so that when the user walks or falls, the buffer unit 30 can be self-rotated about the first axle 20 in response to a stretching force of the rope. The peripheral cog portion of the driven gear 34 is radially formed at a peripheral edge thereof and is protruded out of a peripheral edge of the braking disk 31. A plurality of latches 321 are provided symmetrically to the braking disk 32, wherein each of the latches 321 is coupled at the braking disc 32 via a pin shaft 322. In particular, the pin shaft 322 is extended from an inner end of the latch 321 to couple with the braking disc 32, wherein two braking springs 323 are coupled at the latches 321 respectively to pull two outer ends of the latches 321 towards each other. When the user falls accidentally, the rope is pulled to instantly accelerate the rotation of the rope reel 31 of the buffer unit 30, such that the buffer unit 30 will generate centrifugal force to push the outer ends of the latches 323 away from each other so as to engage with the brake member 14. Therefore, the braking disk 32 is locked by the brake member 14 and is unable to rotate. Since the keyed block 25 is only coupled to the rope reel 31, but not to the braking disk 32, the brake lining 33, or the driven gear 34, a friction force will be generated between the brake lining 33 and the rope reel 31, so as to decelerate the rotation of the rope reel 31 and reduce the gravity acceleration from the falling user, which achieves the safety and anti-falling function.

As shown in FIG. 1, the reel spring 40 is mounted in the chamber 13 for retracting the buffer unit 30. Accordingly, an outer end of the reel spring 40 is coupled at the left cover 11 and an inner end of the reel spring 40 is engaged with the inserting slot 26 of the first axle to generate a retracting force to automatically retract the rope winding around the rope reel 31.

As shown in FIGS. 1 to 7, the linkage structure comprises a second axle 51, a driving gear 52, a main spring 53, and a handle 54. The second axle 51 is extended across chamber 13 and parallel to the first axle 20.

The second axle 51 comprises a main strut 51A rotatably mounted between the first axle seat 121 and the third axle seat 17, and an auxiliary strut 51B rotatably mounted at the second axle seat 161. The driving gear 52 is coaxially coupled at the main strut 51A between the first axle seat 121 and the third axle seat 17. The main strut 51A has an indented ring shaped first buckling member 510 formed thereon. The axial movement of the second axle 51 is limited along the first axle seat 121 and the third axle seat 17 for the driving gear 52 to switch between the first position of engaging with the driven gear 34 and the second position of disengaging with the driven gear 34. The left end of the main strut 50A is protruded to a position between the second axle seat 161 and the third axle seat 17, wherein a first threading member 511 and a retaining lip 512 are provided at the protruded portion of the main strut 50A. The main strut 50A is coaxially sleeved in the main spring 53 between the third axle seat 17 and the driving gear 52 for pushing the retaining lip 512 toward the third axle seat 17, the driving gear 52 will have a tendency to align to the first position at any time. The auxiliary strut 50B has a second threading member 513 on the right end thereof which matches with the first threading member 511 as shown in FIG. 7. The left end of the auxiliary strut 50B is protruded from the second axle seat 161 and has a pin rod 514 radially disposed thereon for coupling to the handle 54 which protrudingly provides a cam 541 on the end thereof. Besides, the free end of the handle 54 has a crank 542 vertically coupled thereon. When the pin rod 514 serves as a pivot point of the handle 54 being insert into the retaining groove 15, the handle 54 is rotated at a clockwise direction to move the cam 541 toward the a side of the left cover 11 of the shell 10 and to drive the second axle 51 to slide outwardly, such that the driving gear 52 overcomes a spring force of the main spring 53 and moves at the second position for disengaging with the driven gear 34. So, the linkage structure will not interfere the regular operation of the buffer unit 30. Therefore, the present invention can function as a regular anti-falling device. When the user falls to pull the rope, the handle 54 can be used to apply the pin rod 514 as a pivot point to rotate counterclockwise for 180 degrees to disengage from the retaining groove 15. So, the cam 541 will detach from the outer side of the left cover 11 and release the storing spring force of the main spring 53. The second axle 51 is moved inwardly to drive the driving gear 52 at the first position of engaging with the driven gear 34. At this point, the crank 542 of the handle 54 will drive the second axle 51 and the first axle 20 to self-rotate, so that the latches 321 of the braking disk 32 can rotate at one direction along the brake member 14 to further rotate the rope reel 31 for retracting the rope. As a result, the user who fails can be lifted up by the retracting rope, which achieves the rescuing purpose easily.

Figure 2:
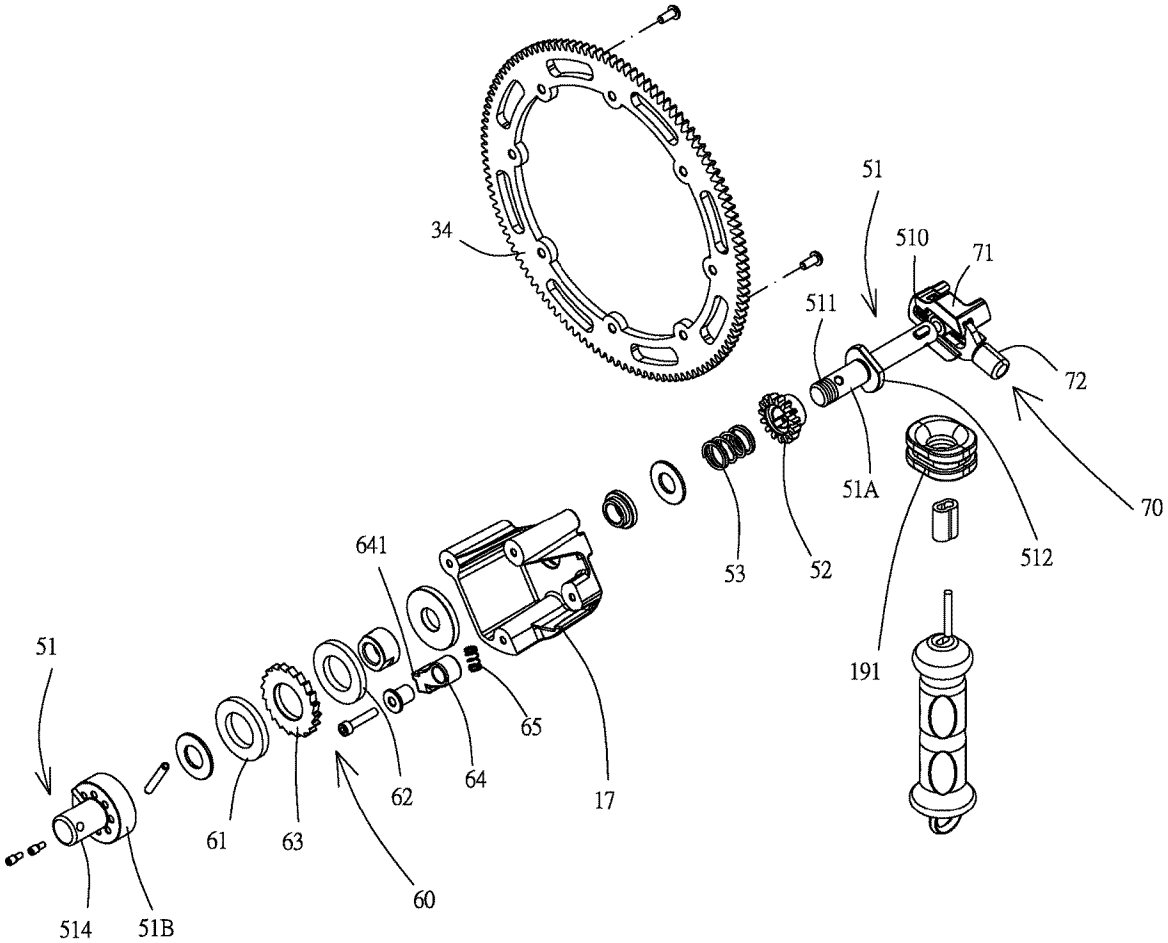
FIG. 2 is a partially exploded perspective view of the anti-falling device with the rope retractable system according to the preferred embodiment of the present invention.

As shown in FIGS. 1, 2, and 7, the unidirectional rotating structure 60 comprises two brake pads 61, 62 are located between the retaining lip 512 of the second axle 51 and the right end of the auxiliary strut 51B. A ratchet wheel 63 is retained and sandwiched between the two brake pads 61, 62. Each of the brake pads 61, 62, and the ratchet wheel 63 has a central hole coaxially aligned with each other that the main strut 51A passes through the central holes of the brake pads 61, 62, and the ratchet wheel 63, wherein the brake pads 61, 62, and the ratchet wheel 63 are clamped and securely locked between the first threading member 511 and the second threading member 513. In addition, the third axle seat 17 has a ratchet block 64 rotatably mounted therein and a restoring spring 65 coupled at the ratchet block 64. The ratchet block 64 has a cog member 641 arranged on the free end thereof, so that the ratchet wheel 63 is limited to respond to the handle 54 to retract the rope in an unidirectional rotation manner. Therefore, the rope will not be released when the user stops rotating the handle 54 during the rope retracting operation.

As shown in FIGS. 1 to 7, a protective structure 70 comprises a socket 71, a button 72, and a forcing spring 73. The socket 71, which is mounted between the first axle seat 121 and the third axle seat 17 in the chamber 13, has a through slot 711 for the main strut passing therethrough and a sliding channel 712 communicatively intersects with the through slot 711. The shell 10 has a through hole 100 communicating the inside and outside of the sliding channel 712. The button 72 is movably mounted at the sliding channel 712 and the through hole 100 correspondingly and has a second buckling member 721, which is slotted hole shaped, for being penetrated by the main strut 51A. The forcing spring 73 is supported between the inner end of the sliding channel 712 and the button 72 to push the button 72, so that when the second axle 51 is at the first position, the second buckling member 721 will automatically buckle the first buckling member 510 without interfering the self-rotation of the second axle 51. Moreover, when the button 72 is actuated to push the forcing spring 73 to a designated position, the second buckling member 721 will be brought to release the first buckling member 510, so that during the process of installing the handle 54 into the retaining groove 15, the cam 541 can be utilized to synchronously bring the second axle 51 to the second position, which enable the present invention to be repeatedly provided for anti-falling uses.

The overall setting mentioned above includes the following improvements.

First, the handle 54 is actuated to drive the second axle 51 to the first position that the second axle 51 is rotated for retracting the rope. Since the second buckling member 721 limits the first buckling member 510, the second axle 51 will not wobble axially or laterally easily when the handle 54 is actuated to drive the second axle 51 to self-rotate. Therefore, a stable transmission between the driving gear 52 and the driven gear 34 can be maintained, which prevents the failure and stalling problems in the process of rope retraction.

Second, through the unidirectional rotating structure 60, the user is able to stop rotating the handle 54 any time for a break during the rope retraction process. In addition, the handle 54 can be actuated and reversely rotated to release the rope. Since the ratchet block 64 will restrict the ratchet wheel 63, the screwed engagement between the first threading member 511 and the second threading member 513 will be released. So, the two brake pads 61, 62 can release the ratchet wheel 63 to allow the handle 54 to be reversely rotated to release the rope for various rescuing conditions and needs.

To sum up, the overall structure and arrangement of the present invention is novel and has the above advantages, which is certainly a great creation of a technical construct and shall match the conditions of patent application. Therefore, it is applied herein in accordance with the law. However, what has been mentioned above is only one of the preferred embodiments of the present invention, which shall not be used to limit the scope of the practice of the present invention. In other words, all equivalent alternatives and modifications according to the claims of the present invention shall still be covered by the claimed scope of the present invention.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An anti-falling device, comprising:

a shell having a chamber and comprising a brake member supported in said chamber;

a first axle extended across said chamber;

a buffer unit, which is coupled at said first axle, comprising a rope reel for winding a rope, a braking disk, and a driven gear engaged with said rope reel when said rope is pulled during a fall of a user;

a reel spring mounted in said chamber for retracting said buffer unit;

a linkage structure which comprises a second axle extended across said chamber, a driving gear coupled at said second axle, and a handle coupled at an outer side of said shell, wherein said second axle comprises a first buckling member, wherein said handle controls said second axle to move between a first position and a second position along an axial direction of said second axle, wherein when said second axle is moved to said first position, the driving gear engages with said driven gear for retracting said rope via a rotational movement of said handle, wherein when said second axle is moved to said second position, the driving gear disengages from said driven gear; and a protective structure which comprises a button movably coupled at said shell and a forcing spring biased against said button, wherein said button has a second buckling member corresponding to said first buckling member that said button is pushed by said forcing spring to engage said second buckling member with said first buckling member, such that when said second axle is moved to said first position, said second axle is enabled to be self-rotated, wherein when said button is actuated to push said forcing spring to a designated position, said first buckling member is released, so as to allow said second axle to move to said second position;

wherein said shell has a through hole communicated with said sliding channel, wherein said button is movably coupled at said sliding channel and said through hole correspondingly, wherein said second axle is extended through said second buckling member, wherein said second buckling member has a slotted hole shape and said first buckling member has an indented ring shape, and said protective structure further comprises a socket, which is mounted in said chamber, having a through slot intersected with said sliding channel for said second axle passing through said through slot, wherein said forcing spring is supported between an inner end of said sliding channel and said button.

2. The anti-falling device, as recited in claim 1, wherein said shell comprises a first axle seat formed at one side of said chamber, a second axle seat formed at an opposite side of said chamber, and a third axle seat formed between said first axle seat and said second axle seat, wherein said second axle comprises a main strut rotatably coupled at said first axle seat and said third axle seat, and an auxiliary strut rotatably coupled said second axle seat, wherein said driving gear is coupled between said first axle seat and said third axle seat and is protruded radially, wherein said first buckling member is formed at said main strut, wherein said main strut is enabled to axially move between said first axle seat and said third axle seat to shift said driving gear between a first position that said driving gear is engaged with said driven gear and a second position that said driving gear is disengaged with said driven gear, wherein said main strut has a first threading member protruded from a left end of said main strut between second axle seat and said third axle seat, wherein said auxiliary strut has a second threading member formed at a right end of said auxiliary strut for matching with said first threading member, wherein a left end of said auxiliary strut is protruded from said second axle seat and is coupled with said handle, wherein said protective structure is mounted between said first axle seat and said third axle seat.

3. The anti-falling device, as recited in claim 2, wherein said main strut further comprises a retaining lip provided between said third axle seat and said second axle seat, two brake pads arranged between said retaining lip and said right end of said auxiliary strut, and a ratchet wheel held between said brake pads, wherein each of said brake pads and said ratchet wheel has a central hole coaxially aligned with each other that said main strut is extended through said central holes of said brake pads and said ratchet wheel, wherein said brake pads and said ratchet wheel are clamped and securely locked between said first threading member and said second threading member, wherein said shell has a ratchet block rotatably mounted therein, wherein said ratchet block has a cog member arranged on a free end thereof and a restoring spring coupled to said ratchet block, such that said ratchet wheel is limited to rotate in unidirectional rotation when said handle is rotated for retracting said rope.

4. The anti-falling device, as recited in claim 2, wherein said main strut further comprises a retaining lip formed between said third axle seat and said second axle seat and a main spring for said main strut extending through said main strut between said third axle seat and said driving gear for pushing said retaining lip toward said third axle seat, so as to enable said driving gear to move to said first position thereof.

5. The anti-falling device, as recited in claim 4, wherein said shell further has a retaining groove indently formed at a peripheral edge of said shell, wherein said auxiliary strut comprises a pin rod extended from said left end thereof and coupled with a cam of said handle, wherein said handle further has a crank formed at a free end thereof, wherein when said pin rod serves as a pivot point of said handle being insert into the retaining groove, said handle is rotated at a clockwise direction to move said cam toward a side of said shell, such that said driving gear overcomes a spring force of said main spring and moves to said second position for disengaging with said driven gear, wherein when said handle is rotated at a counterclockwise direction with respect to said pin rod to detach said pin rod from said retaining groove, said main spring is released to push said driving gear back to said first position for engaging with said driven gear.

6. The anti-falling device, as recited in claim 1, wherein said shell comprises a first axle seat formed at one side of said chamber, a second axle seat formed at an opposite side of said chamber, and a third axle seat formed between said first axle seat and said second axle seat, wherein said second axle comprises a main strut rotatably coupled at said first axle seat and said third axle seat, and an auxiliary strut rotatably coupled said second axle seat, wherein said driving gear is coupled between said first axle seat and said third axle seat and is protruded radially, wherein said first buckling member is formed at said main strut, wherein said main strut is enabled to axially move between said first axle seat and said third axle seat to shift said driving gear between a first position that said driving gear is engaged with said driven gear and a second position that said driving gear is disengaged with said driven gear, wherein said main strut has a first threading member protruded from a left end of said main strut between second axle seat and said third axle seat, wherein said auxiliary strut has a second threading member formed at a right end of said auxiliary strut for matching with said first threading member, wherein a left end of said auxiliary strut is protruded from said second axle seat and is coupled with said handle, wherein said protective structure is mounted between said first axle seat and said third axle seat.

7. The anti-falling device, as recited in claim 6, wherein said main strut further comprises a retaining lip provided between said third axle seat and said second axle seat, two brake pads arranged between said retaining lip and said right end of said auxiliary strut, and a ratchet wheel held between said brake pads, wherein each of said brake pads and said ratchet wheel has a central hole coaxially aligned with each other that said main strut is extended through said central holes of said brake pads and said ratchet wheel, wherein said brake pads and said ratchet wheel are clamped and securely locked between said first threading member and said second threading member, wherein said shell has a ratchet block rotatably mounted therein, wherein said ratchet block has a cog member arranged on a free end thereof and a restoring spring coupled to said ratchet block, such that said ratchet wheel is limited to rotate in unidirectional rotation when said handle is rotated for retracting said rope.

8. The anti-falling device, as recited in claim 6, wherein said main strut further comprises a retaining lip formed between said third axle seat and said second axle seat and a main spring for said main strut extending through said main strut between said third axle seat and said driving gear for pushing said retaining lip toward said third axle seat, so as to enable said driving gear to move to said first position thereof.

9. The anti-falling device, as recited in claim 8, wherein said shell further has a retaining groove indently formed at a peripheral edge of said shell, wherein said auxiliary strut comprises a pin rod extended from said left end thereof and coupled with a cam of said handle, wherein said handle further has a crank formed at a free end thereof, wherein when said pin rod serves as a pivot point of said handle being insert into the retaining groove, said handle is rotated at a clockwise direction to move said cam toward a side of said shell, such that said driving gear overcomes a spring force of said main spring and moves to said second position for disengaging with said driven gear, wherein when said handle is rotated at a counterclockwise direction with respect to said pin rod to detach said pin rod from said retaining groove, said main spring is released to push said driving gear back to said first position for engaging with said driven gear.

10. The anti-falling device, as recited in claim 1, wherein said shell comprises a first axle seat formed at one side of said chamber, a second axle seat formed at an opposite side of said chamber, and a third axle seat formed between said first axle seat and said second axle seat, wherein said second axle comprises a main strut rotatably coupled at said first axle seat and said third axle seat, and an auxiliary strut rotatably coupled said second axle seat, wherein said driving gear is coupled between said first axle seat and said third axle seat and is protruded radially, wherein said first buckling member is formed at said main strut, wherein said main strut is enabled to axially move between said first axle seat and said third axle seat to shift said driving gear between a first position that said driving gear is engaged with said driven gear and a second position that said driving gear is disengaged with said driven gear, wherein said main strut has a first threading member protruded from a left end of said main strut between second axle seat and said third axle seat, wherein said auxiliary strut has a second threading member formed at a right end of said auxiliary strut for matching with said first threading member, wherein a left end of said auxiliary strut is protruded from said second axle seat and is coupled with said handle, wherein said protective structure is mounted between said first axle seat and said third axle seat.

11. The anti-falling device, as recited in claim 10, wherein said main strut further comprises a retaining lip provided between said third axle seat and said second axle seat, two brake pads arranged between said retaining lip and said right end of said auxiliary strut, and a ratchet wheel held between said brake pads, wherein each of said brake pads and said ratchet wheel has a central hole coaxially aligned with each other that said main strut is extended through said central holes of said brake pads and said ratchet wheel, wherein said brake pads and said ratchet wheel are clamped and securely locked between said first threading member and said second threading member, wherein said shell has a ratchet block rotatably mounted therein, wherein said ratchet block has a cog member arranged on a free end thereof and a restoring spring coupled to said ratchet block, such that said ratchet wheel is limited to rotate in unidirectional rotation when said handle is rotated for retracting said rope.

12. The anti-falling device, as recited in claim 10, wherein said main strut further comprises a retaining lip formed between said third axle seat and said second axle seat and a main spring for said main strut extending through said main strut between said third axle seat and said driving gear for pushing said retaining lip toward said third axle seat, so as to enable said driving gear to move to said first position thereof.

13. The anti-falling device, as recited in claim 12, wherein said shell further has a retaining groove indently formed at a peripheral edge of said shell, wherein said auxiliary strut comprises a pin rod extended from said left end thereof and coupled with a cam of said handle, wherein said handle further has a crank formed at a free end thereof, wherein when said pin rod serves as a pivot point of said handle being insert into the retaining groove, said handle is rotated at a clockwise direction to move said cam toward a side of said shell, such that said driving gear overcomes a spring force of said main spring and moves to said second position for disengaging with said driven gear, wherein when said handle is rotated at a counterclockwise direction with respect to said pin rod to detach said pin rod from said retaining groove, said main spring is released to push said driving gear back to said first position for engaging with said driven gear.

14. The anti-falling device, as recited in claim 1, wherein said buffer unit further comprises a brake lining sandwiched between said rope reel and said braking disk for frictionally decelerating the rotation of said rope reel during a fall of the user.

15. The anti-falling device, as recited in claim 14, wherein two ends of said first axle are opposite mounted at two sides of said shell respectively, wherein said brake member is coaxial with said first axle, wherein said first axle comprises a bushing coaxially and rotatably coupled at a periphery of said first axle, a lock nut having a threaded structure coupled with one end of said bushing, a yoke coaxially extended from another end of said bushing, and a keyed block provided between said lock nut and said yoke, wherein said driven gear of said buffer unit is coupled at one side of said rope reel, wherein each of said rope reel, said braking disc, and said brake lining has a center hole coaxially aligned with each other that said bushing is extended through said center holes of said rope reel, said braking disc, and said brake lining, wherein said rope reel, said braking disc, and said brake lining are clamped between said lock nut and said yoke at a position that said keyed block is coupled to said rope reel, wherein said first axle further has an inserting slot indently formed along an outer surface of said yoke, wherein one end of said reel spring is mounted in said chamber and an opposed end of said reel spring is coupled at said inserting slot.

16. The anti-falling device, as recited in claim 1, wherein said buffer unit further comprises a brake lining sandwiched between said rope reel and said braking disk for frictionally decelerating the rotation of said rope reel during a fall of the user.

17. The anti-falling device, as recited in claim 16, wherein two ends of said first axle are opposite mounted at two sides of said shell respectively, wherein said brake member is coaxial with said first axle, wherein said first axle comprises a bushing coaxially and rotatably coupled at a periphery of said first axle, a lock nut having a threaded structure coupled with one end of said bushing, a yoke coaxially extended from another end of said bushing, and a keyed block provided between said lock nut and said yoke, wherein said driven gear of said buffer unit is coupled at one side of said rope reel, wherein each of said rope reel, said braking disc, and said brake lining has a center hole coaxially aligned with each other that said bushing is extended through said center holes of said rope reel, said braking disc, and said brake lining, wherein said rope reel, said braking disc, and said brake lining are clamped between said lock nut and said yoke at a position that said keyed block is coupled to said rope reel, wherein said first axle further has an inserting slot indently formed along an outer surface of said yoke, wherein one end of said reel spring is mounted in said chamber and an opposed end of said reel spring is coupled at said inserting slot.

18. The anti-falling device, as recited in claim 1, further comprising a plurality of latches symmetrically coupled to said braking disk via a plurality of pin shafts at inner ends of said latches, and comprising a plurality of braking springs coupled at said latches respectively to pull two outer ends of said latches toward each other.

* * * * *